United States Patent [19]

Stoll

[11] Patent Number: 4,838,146

[45] Date of Patent: Jun. 13, 1989

[54] FLUID PRESSURE ACTUATOR WITH ANTI-ROTATION SLIDE ATTACHED TO PISTON ROD

[76] Inventor: Kurt Stoll, Lenzahlde 72, 7300 Esslingen, Fed. Rep. of Germany

[21] Appl. No.: 27,158

[22] Filed: Mar. 17, 1987

[30] Foreign Application Priority Data

Mar. 21, 1986 [DE] Fed. Rep. of Germany ..... 3609605

[51] Int. Cl.[4] ..... F15B 14/14; F15B 15/28

[52] U.S. Cl. ..... 92/5 R; 92/13.5; 92/165 PR

[58] Field of Search ..... 92/5 R, 13, 13.5, 13.7, 92/13.8, 128, 139, 165 R, 165 PR, 169.1, 169.4, 161, 88

[56] References Cited

U.S. PATENT DOCUMENTS

| | | | |
|---|---|---|---|
| 552,006 | 12/1895 | Runkel | 92/165 R X |
| 799,531 | 9/1905 | Bryant | 92/5 R X |
| 1,137,455 | 4/1915 | Bowser | 92/5 R X |
| 3,499,387 | 3/1970 | Zippel | 92/13.5 X |
| 4,471,304 | 9/1984 | Wolf | 92/5 R X |
| 4,601,234 | 7/1986 | Hoinkis | 92/165 PR X |
| 4,664,019 | 5/1987 | Lipinski et al. | 92/88 |
| 4,664,020 | 5/1987 | Kaiser | 92/88 |
| 4,669,365 | 6/1987 | Stoll | 92/165 PR |
| 4,724,744 | 2/1988 | Rosengren | 92/88 |
| 4,757,750 | 7/1988 | Stoll | 92/165 R |

FOREIGN PATENT DOCUMENTS

| | | | |
|---|---|---|---|
| 2306630 | 9/1974 | Fed. Rep. of Germany | 92/165 PR |
| 2059592 | 11/1979 | Fed. Rep. of Germany | 92/5 R |
| 2342419 | 9/1977 | France | 92/5 R |
| 258423 | 9/1926 | United Kingdom . | |
| 1394281 | 5/1975 | United Kingdom | 92/165 PR |
| 2021695 | 12/1979 | United Kingdom | 92/5 R |
| 2176536 | 12/1986 | United Kingdom . | |

OTHER PUBLICATIONS

Tol-O-Matic, Inc., "Band Cylinders" product brochure, Minneapolis, Minnesota, 1985.

*Primary Examiner*—Robert E. Garrett
*Assistant Examiner*—George Kapsalas
*Attorney, Agent, or Firm*—McGlew & Tuttle

[57] ABSTRACT

The invention relates to a linear motor with a cylinder (5) containing a piston linked to a piston rod (8) projecting from either of the end faces of the cylinder (5). To secure the piston rod against torsion and rotation, a guide comprising at least two guide ribs (22, 22') arranged on the circumference of the cylinder (5) is provided, these ribs being arranged at a distance from each other and extending in the axial direction of the cylinder (5). A slide (19) seated on the outside of the cylinder (5) and guided on the guide ribs (22, 22') while at least partially encompassing them is fixed to the piston rod (8).

14 Claims, 2 Drawing Sheets

FLUID PRESSURE ACTUATOR WITH ANTI-ROTATION SLIDE ATTACHED TO PISTON ROD

BACKGROUND OF THE INVENTION

1. FIELD OF THE INVENTION

The invention relates to a linear motor with a cylinder containing an axially movable piston to which a piston rod extending through at least one of the end faces of the cylinder is fitted, the section of the piston rod which is outside the cylinder being secured against torsion by being fixed to a co-moving torsion protection element movable in the axial direction of the cylinder in conjunction with a sliding guide fixed thereto.

2. DESCRIPTION OF THE PRIOR ART

Linear motors of this type are generally known, for instance from DE-GM No. 85 05 017, and used for the linear displacement of a power take-off device linked to the piston rod outside the cylinder. The linear motor is actuated by suitable pressurisation, for instance by admitting air to the cylinder operating spaces separated by the piston. By securing the piston rod against torsion, i.e. rotation in relation to the cylinder, the power take-off device can be precisely positioned, which is vital in such fields as handling or robotics. Known linear motors are usually provided for this purpose with a rod extending parallel to the piston rod and connected thereto by means of a carrier, this rod being guided in a sliding guide in the shape of an eye provided on the cylinder. The axial dimension of the sliding guide is relatively short, leading to inadequate precision of the torsion protection element, especially in the extended position of the piston rod. This is particularly noticeable if the piston rod is subjected to torque by way of the power take-off device. This arrangement further requires expensive additional external measures to support the piston rod when displacing heavy weights, since known torsion protection devices are not suitable for supporting functions of this kind. The insufficient torsional rigidity of the known torsion protection device further makes the accurate positioning of the power take-off device virtually impossible.

SUMMARY OF THE INVENTION

It is an object of the invention to provide a linear motor of the type described above with a piston rod precisely secured against torsion and supported irrespective of the piston stroke and capable of precise positioning by simple means.

This problem is solved by a design wherein the sliding guide comprises at least two guide ribs located on the circumference of the cylinder at a distance from each other and at least approximately extending along the entire length of the cylinder, and wherein the torsion protection element is a slide irremovably attached to the outside of the cylinder and guided flat along the guide ribs, said slide at least partially surrounding or encompassing the guide ribs. By guiding the torsion protection device independent of the piston stroke along a great axial distance on the guide ribs of the sliding guide, the piston rod is capable of absorbing high torques created by the power take-off device without even the slightest amount of twisting. Since the slide encompasses the guide ribs and is thus irremovably seated on the cylinder, an excellent support for the piston rod is provided, which is thus made capable of absorbing high transverse forces without the risk of bending. This construction provides a torsion protection element of virtually perfect torsional rigidity suitable for use in positioning and/or position sensing applications. In addition to all these advantages, the linear motor according to the invention is very compact in design and relatively simple and cost-effective to produce.

Advantageous further developments of the invention are described in the sub-claims.

According to one aspect of the invention, an accurate, tilt-free and low-wear guidance of the slide along two circular guides on the cylinder is provided.

Additionally, the construction according to the invention provides a compact design.

This construction also provides a linear motor which is simple to produce, involving in particular virtually no subsequent machining of the guide ribs.

Further, additional components may be fitted to the outside of the cylinder, for example, a second slide to secure the piston rod against extreme loads.

The linear motor construction according to the invention is particularly suitable for the precise positioning of the piston rod or for stroke measurement. Further switching functions may be actuated in dependence on the position of the piston rod, such as the reversal of piston rod movement or the initiation of separate machine components.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENT

Figure 3:
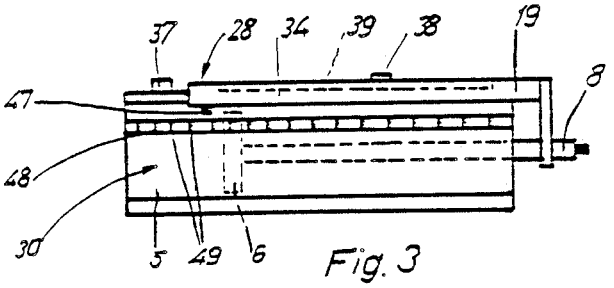
FIG. 3 is a lateral view of another embodiment of the linear motor according to the invention.

The linear motor according to the invention has a cylinder 5 containing an axially movable piston 6 (see FIG. 3). End covers 7 are provided on both ends of the cylinder 5. The piston is provided with an axial piston rod 8 extending coaxial with the cylinder bore 10 and through one of the cylinder end faces 9 or the associated end cover 7 respectively while forming a seal.

There may, however, alternatively be a piston rod extending through both end faces of the cylinder.

There is further provided a torsion preventing device 14 to secure the piston rod 8 against torsion relative to the cylinder 5. This device comprises a torsion protection element 18 in the form of a slide 19 guided in the axial direction of the cylinder along a sliding guide 17 fixed to the cylinder 5. The slide 19 is detachably and in particular irrotatably connected to a piston rod section 16 located outside the cylinder 5 by way of a carrier 15.

Figure 1:
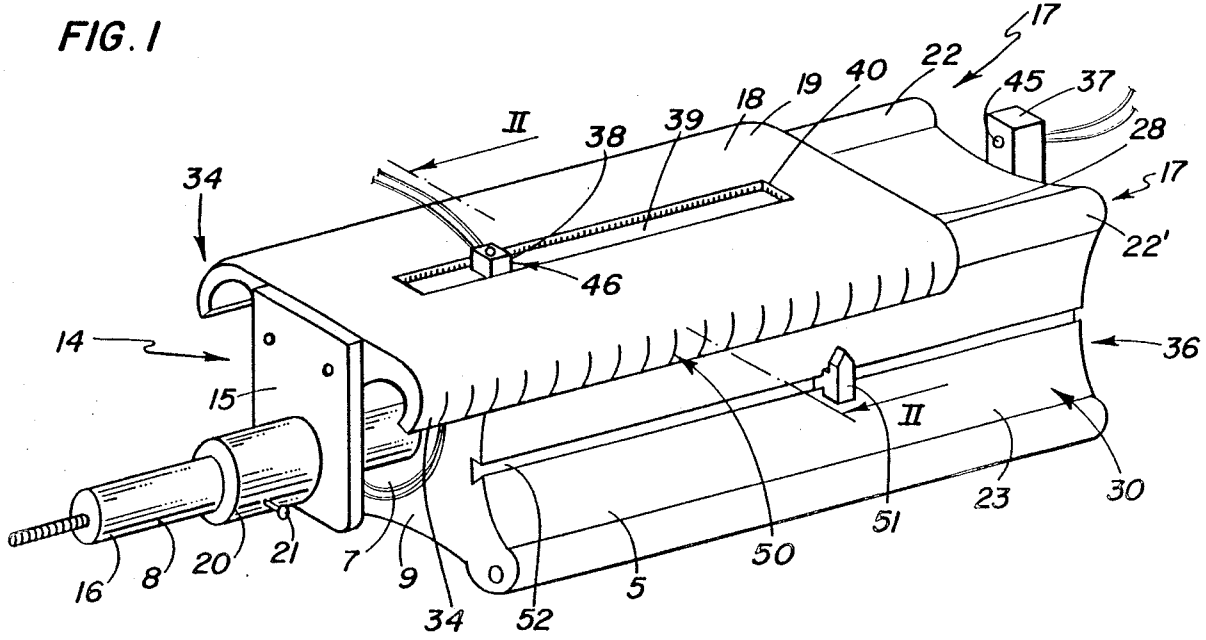
FIG. 1 is a perspective drawing of a first embodiment of a linear motor according to the invention.

The carrier 15 may be bracket-shaped and bolted to the slide 19 as illustrated in FIG. 1, or it may be integral with the slide 19. The bracket is suitably provided with a sleeve 20 for fitting and clamping to the piston rod 8, for instance by means of clamping screws 21.

According to the invention, the sliding guide 17 has at least two guide ribs 22, 22' arranged on the circumference of the cylinder 5 at a distance from each other and extending at least approximately along the entire length of the cylinder 5. They are preferably designed formed integrally with the cylinder 5, as is the case with the embodiment having a profiled tube as a cylinder tube.

The slide 19 is seated on the outside of the cylinder 5, at least partially surrounding or encompassing the two guide ribs 22, 22', thus being prevented from lifting off the cylinder 5 at a right angle to its axial dimension. During assembly, the slide is pushed on the ribs in a suitable manner.

During operation of the linear motor, i.e. the stroke of the piston rod 8, the slide 19 is moved along, executing a traversing movement during which it slides flat along the guide ribs 22, 22'. Since the slide 19 partially encompasses the guide ribs 22, 22', there is the possibility of planar support against the cylinder 5, enabling it to absorb any transversal forces acting on the piston rod 8 and thus to protect the piston rod 8 and its seal in the area of the cylinder end face 9 against damage. The two guide ribs 22, 22' arranged at a distance from each other further provide, if viewed from the front as in FIG. 2, virtually for a two-point support of the slide 19, thereby enabling it to absorb high torques acting on the piston rod 8.

In the embodiment in question, the cylinder tube 23 is, as has been mentioned above, a profiled tube with 4 ribs 24 spaced equally round its circumference and extending over the entire length of the cylinder 5; these four ribs are identical in their shapes. This means that each rib 24 has another rib 24 diametrically opposed on the other side of the cylinder 5, and viewed in cross-section as in FIG. 2, the four ribs are in the four corner areas of an imaginary square. In relation to the cylinder axis, the ribs project substantially radially from the surface of the cylinder 5, creating a gap or recess 30 between each pair of adjacent ribs. The four recesses produced in this manner are slightly concave towards the cylinder bore 10, there being a smooth transition between their sides 31 and the associated rib areas.

Two of these ribs, which are adjacent to each other on the cylinder circumference, represent the guide ribs 22, 22' in the embodiment in question. The function of the remaining two ribs will be explained later.

Figure 2:
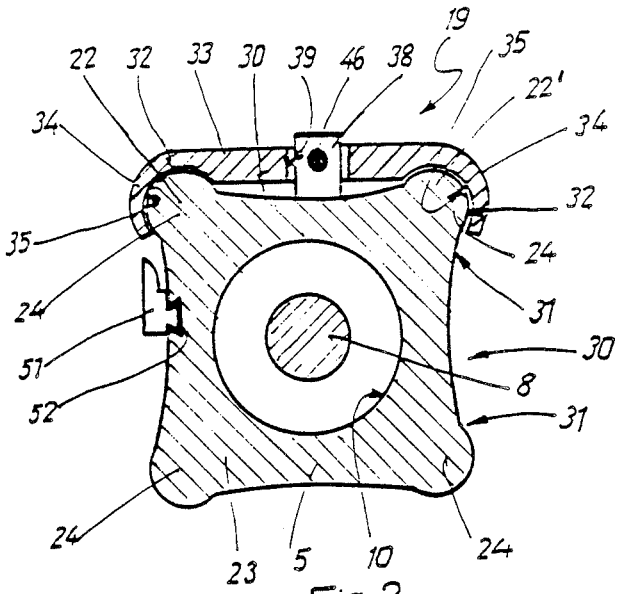
FIG. 2 is a section through the linear motor according to FIG. 1 taken in the direction of the arrows of line II—II of FIG. 1.

The slide guide face 32 of the guide ribs 22, 22', which acts in conjunction with the slide 19, is convex, having, if viewed in cross-section as in FIG. 2, an arcuate form. It can also be said to have the form of a section of a cylinder surface. The slide guide face as illustrated may suitably be represented by the entire surface of the guide ribs 22, 22', providing for a smooth transition into the concave recess 30 at 31.

The slide 19 is so seated on the cylinder 5 that it bridges the associated recess 30 with a base body 33 while encompassing the associated guide rib 22 or 22' with claw-shaped guide extensions 34 integral with the base body 33. The slide 19 has sliding faces 35 with a cross-section complementary to the slide guide faces 32 on which it slides with play; there are two concave sliding faces 35, which at the same time represent the areas of contact of the guide extensions 34 facing the cylinder.

The base body 33 is preferably of a plate-shaped design, its length corresponding to the longitudinal dimension of the cylinder 5, resulting in an approximately C-shaped cross-section of the slide 19, the guide extensions 34 representing the two ends of the C. The possibility that the slide 19 might lift off the cylinder 5 is prevented by the fact that the two guide ribs 22, 22' are encompassed with regard to those parts of their circumferences which are opposite each other if viewed in the circumferential direction of the cylinder and that a section of each slide guide face points away from the slide 19 and towards the opposite side of the circumference of the cylinder 5.

This being so, the slide 19 is guided on the cylinder 5 by the joint action of two sliding faces having curved shapes and extending in the direction of slide traverse, thereby ensuring a tilt-free traversing movement of the slide 19 while simultaneously centering it.

The additional ribs 24 shown opposite the guide ribs in the embodiment of the invention may, if required, also be used as guide ribs or as guide rails for a further slide. This is to be recommended if the piston rod is subjected to extreme transversal forces or if the piston rod extends through both ends of the piston. In the latter case, one of the slides will be associated with the piston rod section projecting from one cylinder end face, while the other slide will be associated with the piston rod section projecting from the opposite cylinder end face.

The precisely guided slide 19 offers the advantage of enabling the simple and accurate positioning of the piston rod or its power take-off device not illustrated here. For this purpose, at least one stop is provided in the traversing path of the slide 19, which will suitably be adjustable in the axial direction of the cylinder and lockable in any desired position.

Figure 4:
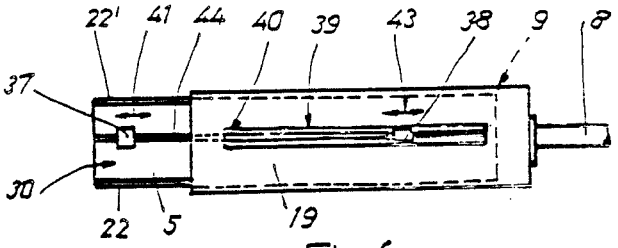
FIG. 4 is a plan view of the linear motor illustrated in FIG. 3.

With reference to FIG. 1, a first stop 37 is shown in the cylinder face area 36 opposite the piston rod 8. This stop projects into the path of the slide 19 and is capable of acting in conjunction with the associated slide end 28 or a stop face provided thereon. In the embodiment according to FIG. 1, the stop 37 is bolted to the associated cylinder end face; it may, however, alternatively be adjustably fitted to a separate stop support (not illustrated). There is further the possibility of arranging the stop 37, as shown in FIGS. 3 and 4, on the circumference of the cylinder 5, in particular in the area of the recess 30 between the guide ribs 22, 22'. In the latter case, a guide groove 44 is provided in the centre of the recess 30, preferably extending along the entire length of the cylinder, in which guide groove the stop 37 is adjustable as indicated by the arrow 41. The first stop 37 determines the depth of piston rod retraction, its position of rest.

Preferably a second stop 38 will be provided to limit the extension stroke of the piston rod 8. The second stop 38 is suitably associated with the cylinder face area 9 associated with the piston rod section 16 and is seated on the cylinder circumference between the guide ribs or rails 22, 22'. It projects through a slot-shaped slide opening 39 extending in the axial direction of the cylinder. The length of the slide opening substantially corresponds to the maximum stroke of the cylinder. To limit its stroke, the end of the slide opening 39 forming a stop face 40 and adjacent to the first stop 37 is contacted by the second stop 38.

The second stop 38, too, is suitably adjustable in the axial direction of the cylinder 5 in accordance with arrow 43. For this purpose, it is likewise supported in an axial groove which may suitably be identical with the guide groove 44 for the first stop 37 (see FIG. 4).

An embodiment not illustrated here provides for the arrangement of both stops 37, 38 in the slide opening 39, each stop acting in conjunction with its adjacent slot end to limit the stroke of the piston rod.

The linear motor according to the invention is further provided with proximity sensors 45, 46 emitting a signal, for instance for stroke reversal, on the approach or arrival of a slide face. For simplicity's sake, these proximity sensors 45, 46 are, in the embodiment shown, directly integrated into the stops 37, 38 and act in conjunction with the opposite stop faces 28, 40 of the slide 19. The proximity sensors are suitably designed as inductive proximity sensors or approach signal transmitters slightly sunk into the stops.

The linear motor according to the invention is, in its embodiment according to FIGS. 3 and 4, further provided with means for positioning the piston rod 8. For this purpose, the slide 19 carries a co-moving sensor 47 in the area of one of the guide extensions 34, this sensor being suitably located at the slide end 28 and thus capable of sweeping along the entire length of the cylinder. This sensor 47 is capable of acting together with one or several pulse generators 48 arranged on the cylinder circumference near the guide extension 34 carrying the sensor 47. The sensor may, of course, alternatively be located on the cylinder, while the pulse generator/s would in this case be fitted to the slide.

During the operation of the cylinder, the relative positions of sensor and pulse generator change, leading to their opposite placing in certain positions of the slide and the creation of a control signal in the sensor. This control signal may then be used, for instance for reversing the movement of the cylinder or to control external machines operating together with the linear motor.

In the embodiment according to FIGS. 3 and 4, the sensor 47 is an inductive sensor emitting a magnetic field and transmitting a control signal when this field is changed, for instance by a piece of metal. A row of metal elements 49 is further arranged on the cylinder 5 in its axial direction, these elements serving as pulse generators. When the slide moves, the sensor 47 passes each of these metal elements in turn, each time transmitting its control signal. With the aid of these individual control signals, the travel of the piston can be measured. There is further the possibility of positioning the piston rod by interrupting the supply of pressure medium to the cylinder on reaching a certain number of control signals.

The number of the pulse generators 48 can be chosen as required, being preferably limited to two to mark the stroke limits.

In an embodiment not illustrated here, the sensor is designed as a reed contact, while the pulse generator/s is/are a magnetic component/magnetic components.

The sensor and/or the pulse generator/s will preferably be adjustable and lockable in the axial direction of the cylinder.

For a visual check of the momentary stroke position, the linear motor illustrated in FIG. 1 is provided with a scale 50 located on the slide 19 and extending in the axial direction of the cylinder, this slide acting in conjunction with a pointer 51. The scale is arranged on the outer surface of either of the guide extensions 34, while the pointer 51 is arranged on the adjacent recess 30 next to the slide 19. In a fixed arrangement, the pointer 51 will suitably be in the area of the cylinder end face 9 associated with the piston rod; in the embodiment in question, the pointer is movably located in a guide groove 52 extending in the axial direction of the cylinder for adaptation to varying stroke lengths.

These stop and indicting systems can, of course, be fitted to the linear motor either individually or in any combination required.

The length of the slide 19 is further, of course, so chosen that at least that slide end section which is opposite the carrier 15 is always in contact with the slide guide faces 32 of the guide ribs. There is no need for the sliding faces to extend over the entire length between the carrier and the slide end 28; this is, however, advisable because it simplifies the production of the slide.

I claim:

1. A linear motor with a cylinder containing an axially movable piston to which a piston rod extending through at least one of the end faces of the cylinder is fitted, the section of the piston rod which is outside the cylinder being secured against torsion by being fixed to a co-moving torsion protection element movable in the axial direction of the cylinder in conjunction with a sliding guide fixed thereto, wherein the sliding guide (17) comprises at least two guide ribs (22, 22'), for example projecting substantially radially from the surface of the cylinder (5) relative to its longitudinal axis and located on the circumference of the cylinder (59), said guide ribs being arranged at a distance from each other and at least approximately extending along the entire length of the cylinder (5), and wherein the torsion protection element (18) is a slide irremovably attached to the outside of the cylinder (5) and guided flat along the guide ribs (22, 22'), said slide at least partially surrounding or encompassing the guide ribs (22, 22'), whereby, for example, the axial dimension of the slide (19) may substantially correspond to the length of the cylinder (5).

2. A linear motor according to claim 1, wherein the slide (19) encompasses the guide ribs (22, 22') at those sections of their circumferences which are opposite each other viewed in the circumferential direction of the cylinder (5) in the manner of a claw, whereby, for example, at least the slide guide face (32) of each guide rib (22, 22') may be convex, suitably having the shape of a section of a cylinder surface, the sliding face (35) of the slide (19) which is in sliding contact with the associated slide guide face (32) having a complementary shape.

3. A linear motor according to claim 1 or 2, wherein at least one adjustable and lockable stop (37, 38) is provided along the traversing path of the cylinder (5), which, for example, may be located in the cylinder face area (36) opposite to the piston rod (8) and may act together with the associated slide end (28) or a stop face (40) provided thereon and wherein at least one proximity sensor (45, 46) acting in conjunction with the slide (19) is provided, which is suitably integrated in either of the stops (37, 38) to act in conjunction with the associated stop face (28, 40) of the slide (19) and which may in particular be designed as an inductive proximity sensor or approach signal transmitter extending into the traversing path of the slide (19).

4. A linear motor according to claim 3, wherein the slide carries at least one adjustable sensor; at least one pulse generator positioned on said cylinder, said adjustable sensor sensing the pulse generated as the sensor and the pulse generator change their relative positions when the slide is moved, the sensor passing the pulse generator closely in a certain slide position.

5. A linear motor according to, 3 wherein the external surface of said cylinder is concave towards the interior of said cylinder in the area adjacent to the guide ribs (22, 22') and on both sides next to the slide.

6. A linear motor according to claim 1, wherein the tube (23) of the cylinder (5) is a profiled tube with several integral guide ribs (22, 22', 24), for example four guide ribs (22, 22', 24) equally spaced round the circumference of the cylinder (5).

7. A linear motor according to claim 2, wherein a section of the slide guide face (32) of the guide ribs (22, 22') points towards that side of the circumference of the cylinder (5) which is opposite the slide (19).

8. A linear motor according to claim 7, wherein the slide (19) bridges the gap (30) between the two guide ribs (22, 22'), whereby the slide (19) may have a plate-shaped base body (33) of a width substantially corresponding to the distance between the two guide ribs (22, 22') and a claw-shaped slide extension (34) encompassing the associated guide rib formed integrally on each side of the base body which is associated with either of the guide ribs (22, 22').

9. A linear motor according to claim 1 further comprising a plurality of metal components provided on one of the slide and the cylinder arranged in the axial direction of the cylinder; and, an inductive sensor means associated with the other of said one of the slide and the cylinder

10. A linear motor according to claim 9, wherein one of the cylinder and the slide is provided with an axial scale for position measuring in conjunction with a pointer located on the other of said one of the cylinder and the slide.

11. A linear motor according to claim 1, wherein at least one adjustable and lockable stop (37, 38) is provided along the traversing path of the cylinder (5), which, for example, may be located in the cylinder face area (36) opposite to the piston rod (8) and may act together with the associated slide end (28) or a stop face provided thereon.

12. A linear motor according to claim 11, wherein an axial groove (44) for the sliding guidance of the stop(s) (37, 38) is formed in the circumference of the cylinder (5).

13. A linear motor according to claim 11, wherein a stop (38) is provided on the circumference of the cylinder between the guide ribs (22, 22') bridged by the slide (19) to project from the cylinder surface, said stop extending through a longitudinal opening (39) of the slide (19) and serving as a stroke limiting device in conjunction with a stop face (40) limiting the length of the slide opening (39), which, for example, may be associated with that end of the slide opening (39) which is opposite to the piston rod (8).

14. A linear motor according claim 13, wherein two stops (37, 38) are arranged in the slide opening (39), each acting in conjunction with a stop face at the associated end of the slide opening (39).

* * * * *